US005205530A

United States Patent [19]

Fish

[11] Patent Number: 5,205,530

[45] Date of Patent: Apr. 27, 1993

[54] RADIALLY SLITTED HOLDER, METHOD OF USE AND APPARATUS FACILITATING USE

[76] Inventor: Ivan L. Fish, 2804 Carolina, NE., Albuquerque, N. Mex. 87110-3312

[21] Appl. No.: 786,454

[22] Filed: Nov. 1, 1991

[51] Int. Cl.[5] ..... F16M 13/00

[52] U.S. Cl. ..... 248/690; 206/293; 206/806; 211/89; 211/124; 248/309.1

[58] Field of Search ..... 248/690, 309.1, 315, 248/316.1, 682, 220.3; 211/89, 113, 124; 206/292, 806, 282, 296, 293

[56] References Cited

U.S. PATENT DOCUMENTS

| | | | |
|---|---|---|---|
| 1,050,771 | 1/1913 | Leupold . | |
| 2,294,527 | 9/1942 | Weiss | 211/89 |
| 2,339,719 | 1/1944 | Waters | 248/690 |
| 2,396,906 | 2/1945 | Windson | 46/90 |
| 2,825,952 | 8/1955 | Van Driel | 24/138 |
| 2,981,990 | 9/1957 | Balderree, Jr. | 24/30.5 |
| 3,170,213 | 7/1962 | Thomas, Jr. | 24/255 |
| 3,299,442 | 1/1967 | White et al. | 248/690 X |
| 3,822,441 | 11/1972 | Paxton | 24/30.5 S |
| 3,962,757 | 3/1975 | Gedney | 24/255 BS |
| 4,045,844 | 6/1976 | Murray | 24/81 DM |
| 4,190,151 | 11/1978 | Russell | 206/281 |
| 4,333,566 | 12/1980 | Holmes | 206/343 |
| 4,361,935 | 6/1980 | Paxton | 24/30.5 R |
| 4,503,591 | 5/1983 | Adamska-Koperska | 24/161 |
| 4,509,231 | 5/1983 | Paxton | 24/30.5 R |
| 4,571,779 | 5/1983 | Koerschner et al. | 24/30.5 S |
| 4,644,610 | 9/1984 | Fish | 24/30.5 S |
| 4,682,389 | 11/1986 | Callender | 24/599 |
| 4,760,624 | 9/1986 | Fish | 24/30.5 S |
| 4,865,205 | 11/1983 | Thorneburg et al. | 211/59.1 |
| 5,027,945 | 7/1991 | Wilkins | 206/292 X |
| 5,125,614 | 6/1992 | Kryger | 248/682 X |

FOREIGN PATENT DOCUMENTS

| | | | |
|---|---|---|---|
| 144921 | 12/1948 | Australia | 211/89 |
| 2310956 | 9/1974 | Fed. Rep. of Germany | 248/690 |
| 77387 | 9/1959 | France . | |
| 2399365 | 4/1979 | France | 206/296 |
| 683656 | 2/1965 | Italy | 211/89 |
| 459872 | 7/1968 | Switzerland . | |
| 2028413 | 8/1978 | United Kingdom . | |

*Primary Examiner*—David L. Talbott

*Attorney, Agent, or Firm*—Deborah A. Peacock; Jeffrey D. Myers

[57] ABSTRACT

A radially slitted holder having a central membrane with two access holes one of which is intersected by at least one radial slit. A radially slitted holder may be deployed using the method and facilitating apparatus of the invention, which employ a rod having a channeled portion therein.

10 Claims, 4 Drawing Sheets

RADIALLY SLITTED HOLDER, METHOD OF USE AND APPARATUS FACILITATING USE

BACKGROUND OF THE INVENTION

1. Field of the Invention (Technical Field)

This invention relates generally to holding and closing devices and methods, and more particularly to reusable apparatuses for securing flexible items and containers such as socks, plastic bags and the like, and for holding items such as clothes, tools, utensils, wires, and cables in a desired location and spacing.

2. Background Art

An effective general-purpose radially slitted holder is disclosed in U.S. Pat. No. 4,644,610, to Fish. Unfortunately, that holder is not optimal in that all perforations in the central membrane of the holder connect to a single access hole. The radially slitted holder of the present invention provides a second access hole through which a rigid or flexible connector, such as a one-half or one-inch tagging barb (commonly known in the art), may be fastened.

It has heretofore only been known in the art to deploy radially slitted holders entirely by hand. With the method and facilitating apparatus of the present invention, such holders may be deployed onto flexible objects more efficiently than solely by hand, as known heretofore.

SUMMARY OF THE INVENTION (DISCLOSURE OF THE INVENTION)

The present invention is of a radially slitted holder, a method of deploying radially slitted holders, and an apparatus facilitating deployment of radially slitted holders.

The radially slitted holder of the invention comprises a central membrane having a first access hole, a second access hole, and at least one slit radially disposed from the first access hole. Preferably, the holder additionally comprises a flat tag and a hook (such as a hook-shaped member, a double lock slot, or a member having an opening and zig-zag access slit) for hooking the holder to a support.

The method of securing a flexible object of the invention comprises: (a) providing a rod having a channeled portion to a support; (b) folding a desired portion of the flexible object over the channeled portion., and (c) placing the desired portion of the flexible object through a radially slitted holder, the radially slitted holder comprising a central membrane having an access hole and at least one slit radially disposed from the access hole. Preferably, the radially slitted holder is placed on the rod prior to the folding step (b) and the radially slitted holder and the flexible object are simultaneously removed from the rod such that the desired portion of the flexible object remains within the radially slitted holder.

The facilitating apparatus of the invention, for storing a radially slitted holder and deploying the holder onto a flexible object, comprises a rod with a channeled portion and a portion for storing a radially slitted holder and a support for the rod. The support can comprise threading on an end of the rod (such that the end of the rod is either sharp or blunt), and a nut or nuts fastenable to the threaded end. In the preferred embodiment, the support comprises an angled portion at an end of the rod and a slot into which the angled portion is pivotably placed and the channeled portion of the rod is U-shaped. The channeled portion may comprise two tines at an end of the rod, preferably forming a hooded tapered slot permitting deploying the holder onto a flexible object using a single extremity.

A primary object of the present invention is to provide a radially slitted holder having a second access hole whereby attaching means may join the holder and the held object to prevent inadvertent separation.

Another object of the present invention is to provide means whereby radially slitted holders may be stored and rapidly and efficiently deployed when needed.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENTS (BEST MODES FOR CARRYING OUT THE INVENTION)

The present invention comprises a radially slitted holder having characteristics superior to those known in the art, a method of efficiently deploying radially slitted holders, and an apparatus facilitating storage and deployment of radially slitted holders.

Figure 1:
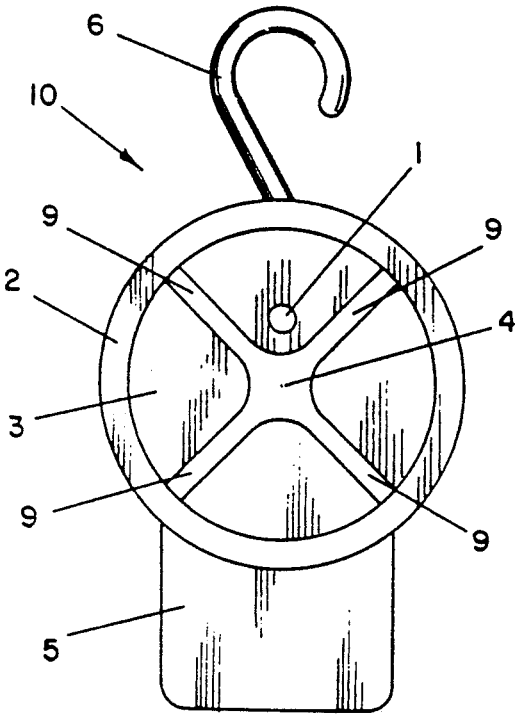
FIG. 1 is a front view of the preferred radially slitted holder of the invention, having a hook and a display tag.
Figure 2:
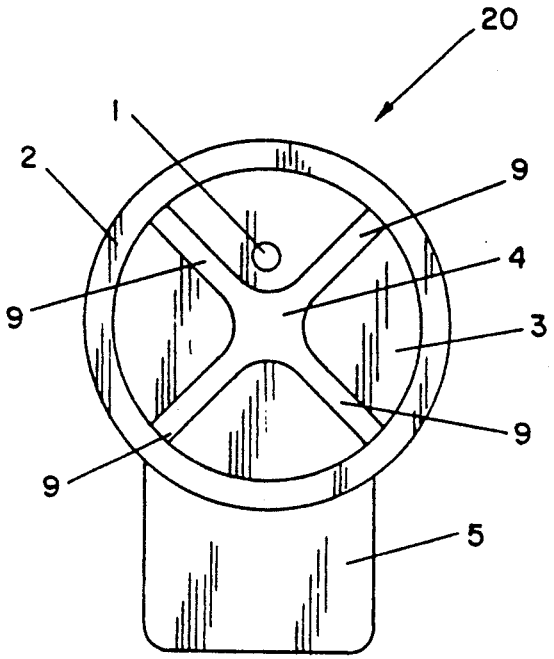
FIG. 2 is a front view of an alternative radially slitted holder of the invention having a display tag but no hook.
Figure 3:
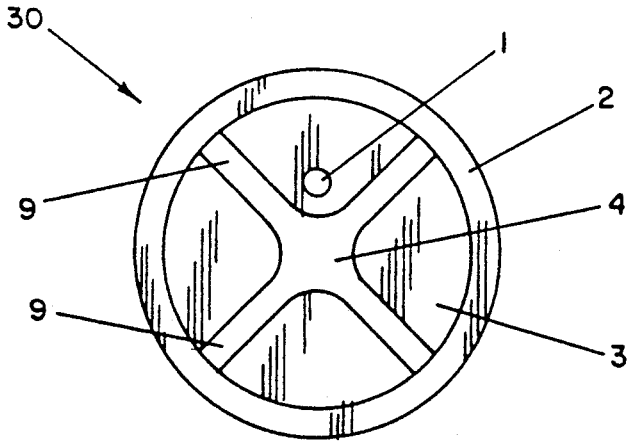
FIG. 3 is a front view of an alternative radially slitted holder of the invention having no display tag or hook.

As illustrated in FIGS. 1–3 and 11–13, which illustrate preferred and alternative embodiments of the invention, radially slitted holders 10, 20, and 30 each comprise bead 2 surrounding central membrane 3, central access hole 4 intersected by at least one radial slit 9, and auxiliary access hole 1, preferably having no intersecting slits. There may be a plurality of radial slits 9 such as shown in FIGS. 1–3, or there may be a single radial slit, such as the zig-zag access slit disclosed in U.S. Pat. No. 4,760,624, entitled "Closer/Holder with Access Slit," to Fish, which is incorporated by reference herein. Radial slit 9 may be straight, a zig-zap shape, or a numerous variety of other shapes. Radially slitted holders 10 and 20 additionally comprise display tag 5. Preferred radially slitted holder 10 additionally comprises hook 6, and is additionally illustrated by FIGS. 11–13. The radially slitted holder of the present invention may incorporate striations or serrations (not shown) on the outside of bead 2, as disclosed in U.S. Pat. No. 4,644,610, to Fish, which is also incorporated by reference herein.

The radially slitted holder of the present invention may generally be constructed and used in the same manner as disclosed in U.S. Pat. No. 4,644,610, cols. 2–4. With the '610 holder, all perforations in the central membrane of the holder connect to a single access hole. Unfortunately, in the clothing and small consumables retail industries, consumers can inadvertently disconnect goods from the holder before purchase, unless the goods are connected to the holder by an additional connector wrapped around the outer circular bead of the holder. The present invention, by providing an auxiliary access hole 1, assists in better connection of the holder to the goods.

The radially slitted holder of the present invention provides auxiliary access hole 1 through which a rigid or flexible connector (not shown) may be fastened. For example, a pair of socks may be held by the holder of the present invention through central access hole 3 and additionally by a flexible connector, such as a one-half or one-inch tagging barb, passing through each sock and auxiliary access hole 1. Machines are known in the art for easily and rapidly deploying such flexible connectors. Such connectors may be used to secure items to the radially slitted holder such as clothing, bags of small articles, and the like. The connectors may be removed by the consumer after purchase, whereupon the consumer can retain and use the radially slitted holder for a variety of purposes, as described in U.S. Pat. No. 4,644,610, to Fish.

Because auxiliary access hole 1 in conjunction with a connector can keep a consumable together with the radially slitted holder of the invention until the connector is intentionally cut, display tag 5 has enhanced utility. Product description and pricing information may be placed upon display tag 5 with assurance that the information will stay with the corresponding consumable until after purchase. Display tag 5 may also be used for writing on or for affixing a gummed label. While display tag 5 is shown to be rectangular, it may have any desired shape or size as determined by utility, economics, and aesthetics.

Hook 6 permits the radially slitted holder and its corresponding consumable to be displayed on a display rack. For example, hook 6 permits hanging of the radially slitted holder and connected consumable from a rod. Alternatively, hook 6 may be replaced by other hooking means such as a double lock slot (pictured in FIG. 3 of U.S. Pat. No. 4,644,610, to Fish), apparatuses described in U.S. Pat. No. 4,760,624, and the like.

Thus, it is seen that the radially slitted holder of the present invention is a significant improvement upon those previously known in the art.

The present invention also provides a new, useful, and unobvious method and apparatus for deploying radially slitted holders, as disclosed below.

It has heretofore only been known in the art to deploy radially slitted holders entirely by hand. For example, to close a plastic trash bag, it is known to twist the open end of the bag into a cylindrical shape, fold the cylinder in half, locate a radially slitted holder, then force the folded cylinder through the radially slitted holder. This process is often cumbersome, as the plastic bag must be pushed through the holder on one side (during which process fingers may be caught or scratched), then pulled through from the other side.

Figure 4:
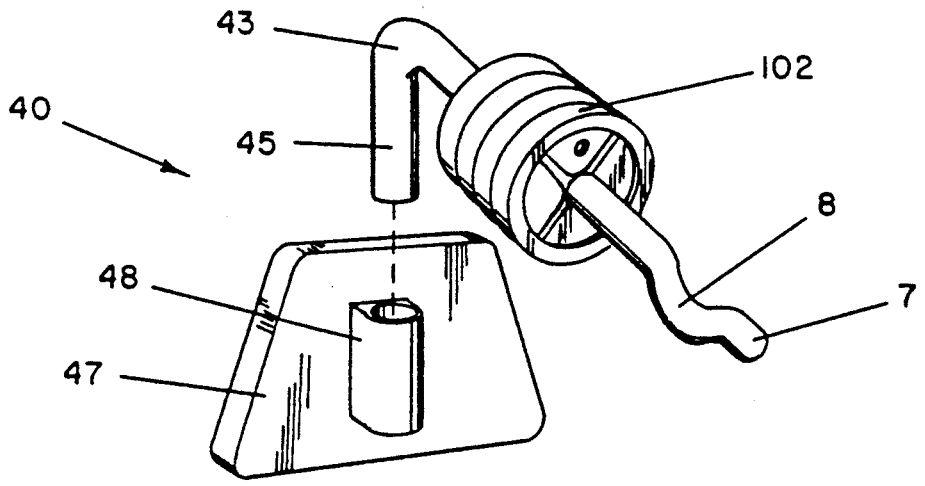
FIG. 4 is a perspective view of the preferred facilitating apparatus of the invention, having an end forming a right angle resting in a support slot and showing radially slitted holders thereon.

FIGS. 4–10 show preferred and alternative facilitating apparatuses 40, 50, 60, 70, 80, 90, and 100 which are useful in storing and deploying radially slitted holders. Each such apparatus comprises rod 7 having channeled portion 8 therein. Channeled portion 8 is preferably U-shaped, but may be V-shaped, rectangular, or other shape creating a channeled zone within rod 7. As illustrated in FIG. 4, a plurality of radially slitted holders 102 may be stored on such apparatuses.

As shown in FIG. 4, which illustrates the preferred embodiment of the facilitating apparatus, rod 7 may have angle 43 forming angled end 45 securable within rod support 47 having support slot 48. Rod 7 preferably is pivotable within support slot 48. In this embodiment, facilitating apparatus 40 may comprise rod 7 alone or both rod 7 and rod support 47, but preferably both.

Figure 5:
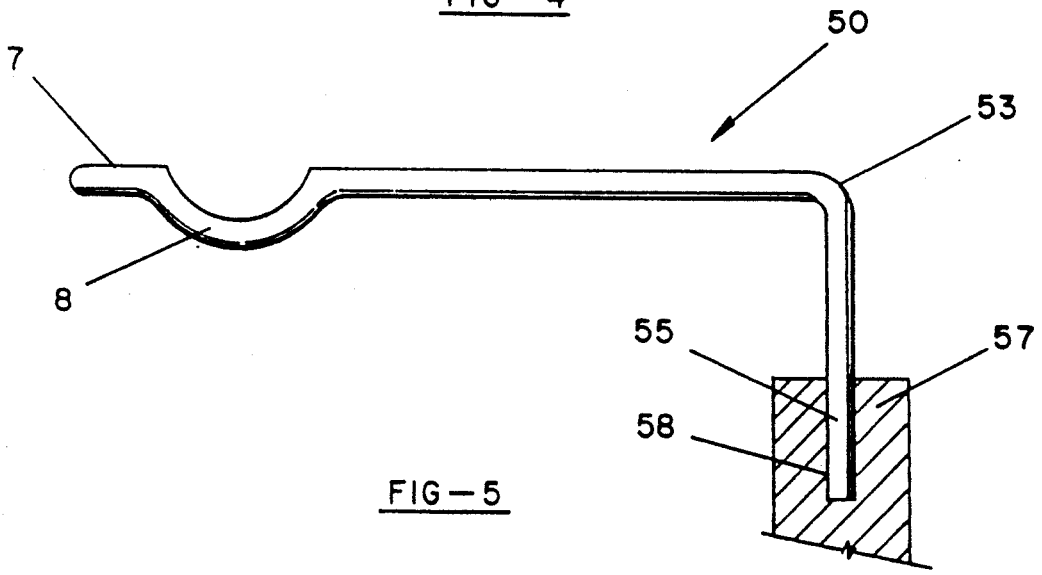
FIG. 5 is a cut-away perspective view of an alternative facilitating apparatus of the invention having an end forming a right angle resting in a support hole.

As illustrated in FIG. 5, rod 7 may have angle 53 forming angled end 55 securable within rod support 57 having support hole 58. Rod 7 preferably is pivotable within support hole 58. In this embodiment, facilitating apparatus 50 may comprise rod 7 alone or both rod 7 and rod support 57.

Figure 6:
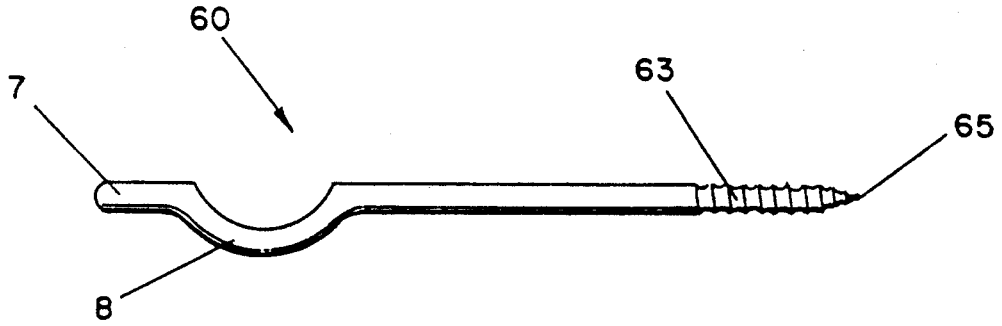
FIG. 6 is a perspective view of an alternative facilitating apparatus of the invention having a sharp end with threading.

As illustrated in FIG. 6, rod 7 may have threaded end 63 terminating in sharp projection 65. In this embodiment, facilitating apparatus 60 may be secured to a support by screwing into a wall, post, door, or the like.

Figure 7:
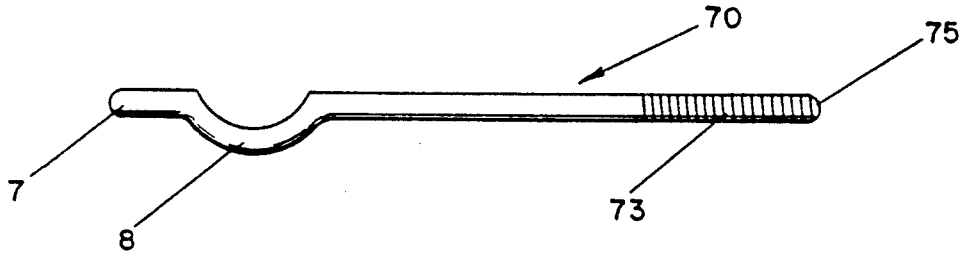
FIG. 7 is a perspective view of an alternative facilitating apparatus of the invention having a blunt end with threading.

As illustrated in FIG. 7, rod 7 may have threaded end 73 terminating in blunt end 75. In this embodiment, facilitating apparatus 70 may be secured to any support having female threading corresponding to that of threaded end 73.

Figure 8:
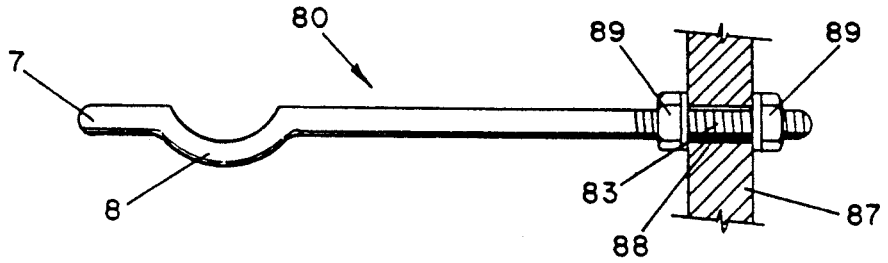
FIG. 8 is a cut-away perspective view of an alternative facilitating apparatus of the invention threaded into a support and secured by two nuts.

As illustrated in FIG. 8, rod 7 may have threaded end 83 securable within rod support 87 having support hole 88 and nuts 89. In this embodiment, facilitating apparatus 80 comprises both rod 7 and rod support 87, and, optionally, nuts 89. Nuts 89 on both sides (rather than a single nut on a single side) of rod support 87 assist in retention in place of rod support 87 during use of facilitating apparatus 80. Nuts 89 may additionally comprise washers (not shown).

Figure 9:
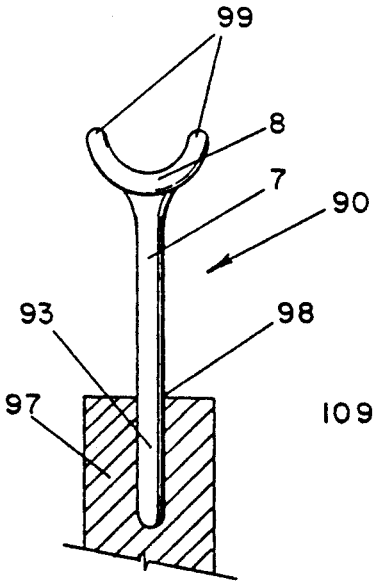
FIG. 9 is a cut-away perspective view of a facilitating apparatus of the invention having a tined end and a secured opposite end.

As illustrated in FIG. 9, rod 7 may have tines 99 forming channeled portion 8 therebetween at an end of rod 7 and opposite secured end 93 securable within rod support 97 having support hole 98. In this embodiment, rod 7 is secured in a vertical rather than a horizontal position, and facilitating apparatus 90 may comprise rod 7 alone or both rod 7 and rod support 97.

Figure 10:
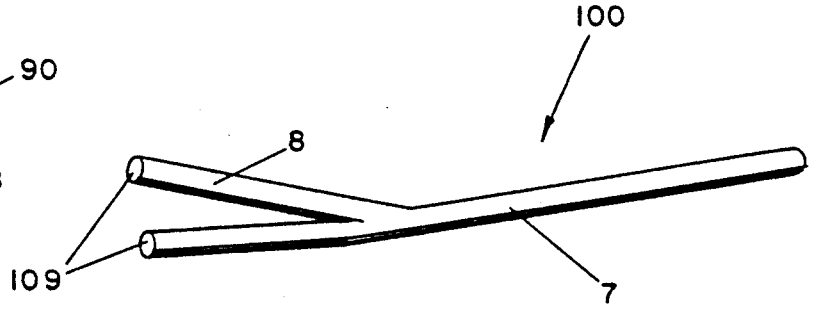
FIG. 10 is a perspective view of an alternative facilitating apparatus of the invention usable with one or both hands.
Figure 11:
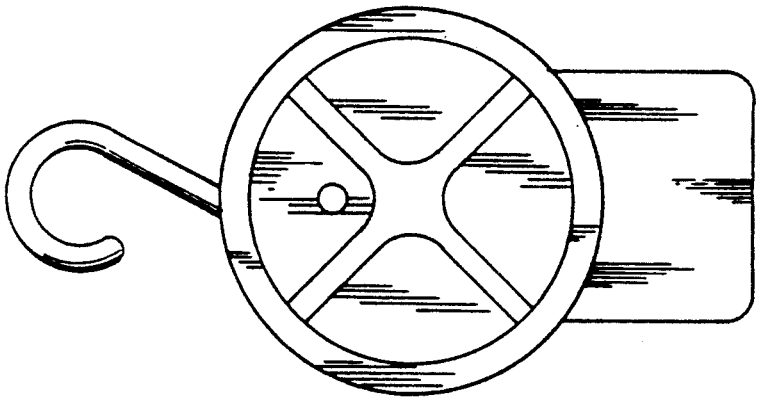
FIG. 11 is a front view of the preferred radially slitted holder of the invention.
Figure 12:
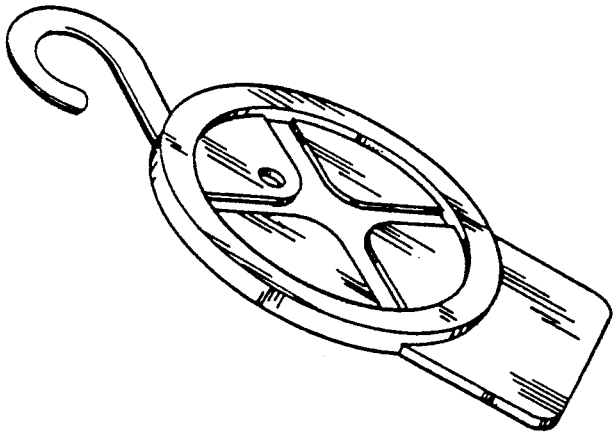
FIG. 12 is a side view of the preferred radially slitted holder of the invention.
Figure 13:
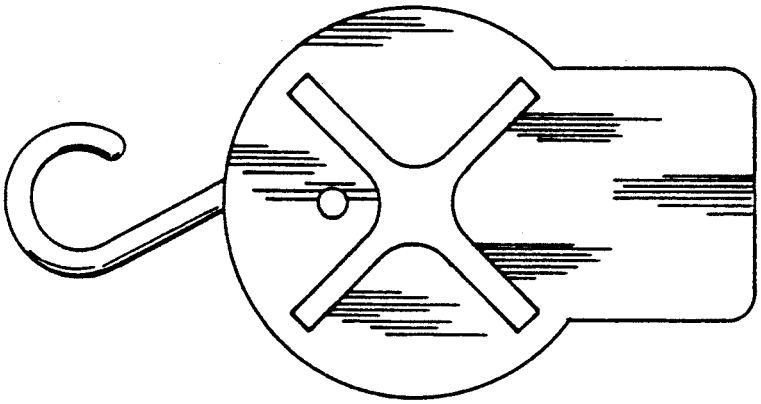
FIG. 13 is a back view of the preferred radially slitted holder of the invention.

As illustrated in FIG. 10, rod 7 may have tines 109 forming channeled portion 8 as a hooded tapered slot. Facilitating apparatus 100 is particularly useful for handicapped people who may be physically or visually incapacitated. This alternative embodiment is securable to a support in the same manners as above disclosed in FIGS. 4–8.

Radially slitted holders may be deployed onto a flexible object using the apparatuses depicted in FIGS. 4–10, if radially slitted holders are stored on the apparatus, as illustrated in FIG. 4, as follows: First, a desired portion of the flexible object is folded over channeled portion 8 such that the flexible object forms a U shape opposite in concavity to that of channeled portion 8. Second, the stored radially slitted holder closest to channeled portion 8 is pulled forward and over into channeled portion 8 so as to force the flexible object through the holder's central access hole. Finally, the holder and the flexible object are together pulled off of the facilitating apparatus such that the flexible object remains gripped by the holder.

Alternatively, if radially slitted holders are not stored on a facilitating apparatus, the holders may be deployed as follows: First, a desired portion of the flexible object is folded over channeled portion 8 such that the flexible object forms a U shape opposite in concavity to that of channeled portion 8. Second, a radially slitted holder is threaded onto rod 7 through the holder's central access hole. Third, the radially slitted holder is pushed into channeled portion 8 so as to force the flexible object through the holder's central access hole. Finally, the holder and the flexible object are together pulled off of the facilitating apparatus such that the flexible object remains gripped by the holder.

Facilitating apparatus 100, illustrated in FIG. 10, allows a person to place, with a single extremity, items to be closed (or held together) into channeled portion 8, which items are held taut and in place by friction. A radially slitted holder stored on facilitating apparatus 100 may then be pulled forward and down, with the same extremity, over the item to be closed (or items to be held together), and together slid off the facilitating apparatus 100 such that the item to be closed remains gripped by the holder. This embodiment is particularly useful for persons having use only of a single arm or hand, or of only a foot or feet.

The above methods of deploying radially slitted holders by means of a facilitating apparatus are superior to the heretofore known method of deploying holders entirely by hand, both in terms of efficiency and safety. One need not hunt for an available radially slitted holder when they are stored on a facilitating apparatus, as in FIG. 4. The step of forcing a flexible object through the holder is quick with a facilitating apparatus. Additionally, the chance of injuring a finger is reduced because fingers need not push a flexible object through the holder when using a facilitating apparatus.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A radially slitted closer, holder, and display device comprising: a central membrane having a first access hole, a plurality of slits radially disposed from said first access hole, a plurality of flaps in said central membrane which are defined by said slits, and a second access hole disposed in one of said flaps.

2. The radially slitted holder of claim 1 additionally comprising a generally flat tag.

3. The radially slitted holder of claim 1 additionally comprising means for hooking said holder to a support.

4. The radially slitted holder of claim 3 wherein said hooking means comprises a hook-shaped member.

5. The radially slitted holder of claim 3 wherein said hooking means comprises a double lock slot.

6. The radially slitted holder of claim 3 wherein said hooking means comprises a member comprising an opening and a zig-zag access slit.

7. A radially slitted closer, holder, and display device comprising:

a flexible central membrane having a primary access hole centrally disposed therein; and a circumferential member surrounding said central membrane;

said flexible central membrane having a plurality of slits entending from said from first access hole to said circumferential member, said slits defining a plurality of flaps in said flexible central membrane, at least one of said flaps having an auxiliary access hole therein.

8. The invention of claim 7 wherein said circumferential member has a thickness greater than a thickness of said central membrane.

9. The invention of claim 7 wherein said circumferential member comprises a smooth exterior surface.

10. The invention of claim 7 where each of said flaps is rounded at an end thereof.

* * * * *